US006167193A

United States Patent [19]

Birdsell et al.

[11] Patent Number: 6,167,193

[45] Date of Patent: Dec. 26, 2000

[54] PORTABLE ELECTRIC HEATER WITH DIGITAL DISPLAY

[75] Inventors: Walter Birdsell, Marlborough; Bruce Chute, Northborough, both of Mass.

[73] Assignee: Honeywell Inc., Minneapolis, Minn.

[21] Appl. No.: 09/449,806

[22] Filed: Nov. 26, 1999

[51] Int. Cl.[7] ..... F24H 3/00

[52] U.S. Cl. ..... 392/365; 219/506

[58] Field of Search ..... 392/365–369, 392/360, 373–374; 219/506, 480

[56] References Cited

U.S. PATENT DOCUMENTS 4,642,441 2/1987 Kenyon ..... 392/365
5,278,936 1/1994 Shao ..... 392/365
5,463,203 10/1995 Moore ..... 392/368
5,771,959 6/1998 Westbrooks, Jr. et al. ..... 219/386
5,787,228 7/1998 Fiely et al. ..... 392/383
5,805,767 9/1998 Jouas et al. ..... 392/373

*Primary Examiner*—John A. Jeffery
*Attorney, Agent, or Firm*—John E. Toupal; Harold G. Jarcho

[57] ABSTRACT

A portable electrical heater including a portable housing defining an air inlet, an air outlet, and an air flow path therebetween; a blower for circulating air through the air flow path; an electrically powered heater element disposed in the air flow path; and a control board including a selector for effecting operation of the heater, and a digital display. An ambient temperature sensor and an electronic controller controls energization of the display and heater element in response to inputs from the selector and temperature sensor.

19 Claims, 4 Drawing Sheets

PORTABLE ELECTRIC HEATER WITH DIGITAL DISPLAY

BACKGROUND OF THE INVENTION

The invention relates generally to portable electric heaters and, more particularly, to portable heaters employing a motor driven fan to circulate air through a path retaining a resistive heating element.

Portable electric heaters are used extensively to provide a more comfortable ambient temperature in regions of small volume or which central heating is not available. For example, portable heaters often are used in bathrooms, bedrooms, sitting rooms, garages or in the vicinity of a person engaged in a relatively stationary activity such as reading, television or computer screen viewing, sewing and the like. To enhance the use of portable electric heaters, various steps have been taken to enhance operating utility and efficiency, extend heater life, and reduce cost. However, further improvements in these portable heater characteristics continue to be sought.

The object of this invention, therefore, is to provide an improved portable electric heater.

SUMMARY OF THE INVENTION

The invention is a portable electrical heater including a portable housing defining an air inlet, an air outlet, and an air flow path therebetween; a blower for circulating air through the air flow path; an electrically powered heater element disposed in the air flow path; and a control board including a selector for effecting operation of the heater, and display means including a digital display. Also included are an ambient temperature sensor and an electronic controller for controlling energization of the display and heater element in response to inputs from the selector and temperature sensor. The selector and display allow a user to effectively control heater operation.

According to features of the invention, the selector includes mode and temperature selector switches; the display further includes ambient temperature and set temperature lamps; and the controller responds to an input from the temperature sensor and selective actuation of the mode switch by establishing alternately a temperature selection mode or an automatic ambient temperature mode. In the temperature selection mode the controller illuminates the set temperature lamp, and in response to activation of the temperature selector switch provides on the digital display a selected temperature while in the automatic ambient temperature mode the controller illuminates the ambient temperature lamp, provides on the digital display ambient temperature sensed by the temperature sensor, and controls energization of the heater element to maintain an ambient temperature equal to the selected temperature. These features facilitate desired control of heater operation.

According to one feature of the invention, the controller automatically reestablishes the automatic ambient temperature mode a given time delay period after actuation of the mode switch to establish the temperature selection mode. Return to automatic mode eliminates a procedural step required of the user.

According to an additional feature of the invention, the temperature selector switch includes a first switch activatable to increase selected temperature and a second switch activatable to decrease selected temperature. The first and second switches facilitate temperature selection.

According to a further feature of the invention, the display also includes an automatic operation lamp which the controller illuminates in the automatic ambient temperature mode. Illumination of the automatic operation lamp assures the user that the heater is functioning in the desired mode.

According to still other features of the invention, the display also includes a timer lamp, the selector includes a delay period switch means; and the controller further responds to selective actuation of the mode switch to establish, alternatively to the temperature selection mode and the automatic ambient temperature mode, a delayed shut-off mode in which the controller illuminates the timer lamp. Also, in response to activation of the delay period switch the controller provides on the digital display a selected delay period; and after the selected delay period deenergizes the heater element.

According to still additional features of the invention, the display further includes a continuous operation lamp and the controller responds to selective actuation of the mode switch by illuminating the continuous operation lamp and establishing alternatively to the automatic ambient temperature mode a continuous operation mode in which the heater element is continuously energized. The continuous operation mode increases heater utility.

According to other features of the invention, the display also includes high power and low power lamps; and the controller further responds to selective actuation of the mode switch by establishing alternatively either a high power mode or a low power mode. In the high power mode the controller illuminates the high power lamp and energizes the heater at a given power level, and in the low power mode illuminates the low power lamp and energizes the heater at a predetermined power level substantially less than the given power level. Additional operational flexibility and utility are provided by these features.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 3:
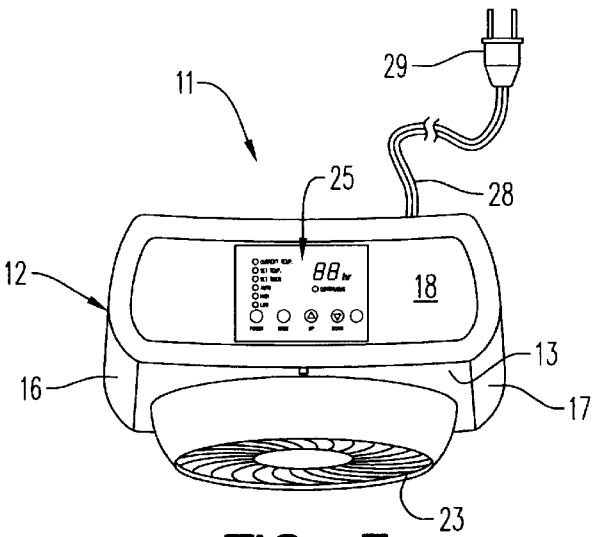
FIG. 3 is a top front perspective view of the heater shown in FIGS. 1 and 2.
Figure 2:
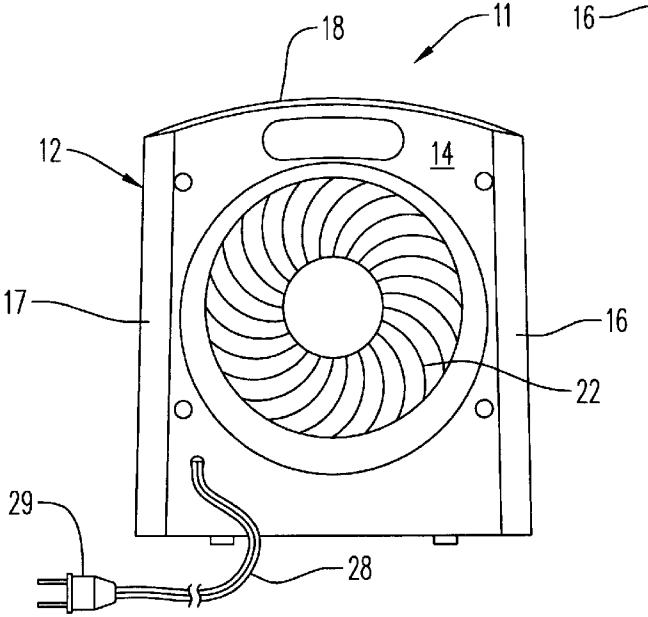
FIG. 2 is a rear view of the heater shown in FIG. 1.
Figure 1:
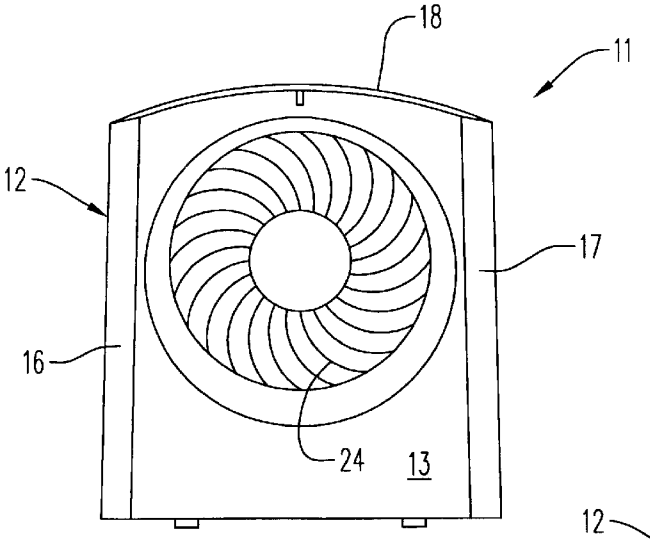
FIG. 1 is a front view of a portable heater according to the invention.

A heater 11 has a portable housing 12 formed by a front wall 13, a rear wall 14, side walls 16, 17 and an arcuate top wall 18. Defined by the rear wall 14 is an air inlet 21 covered by an inlet grill 22 while an air outlet 23 is defined by the front wall 13 and covered by an outlet grill 24, (FIGS. 1–3). Mounted on the top wall 18 is a selector and display board 25 described hereinafter. An electrical cord 28 extends out of the housing 12 and includes a plug for insertion into a conventional power outlet socket (not shown).

Figure 4:
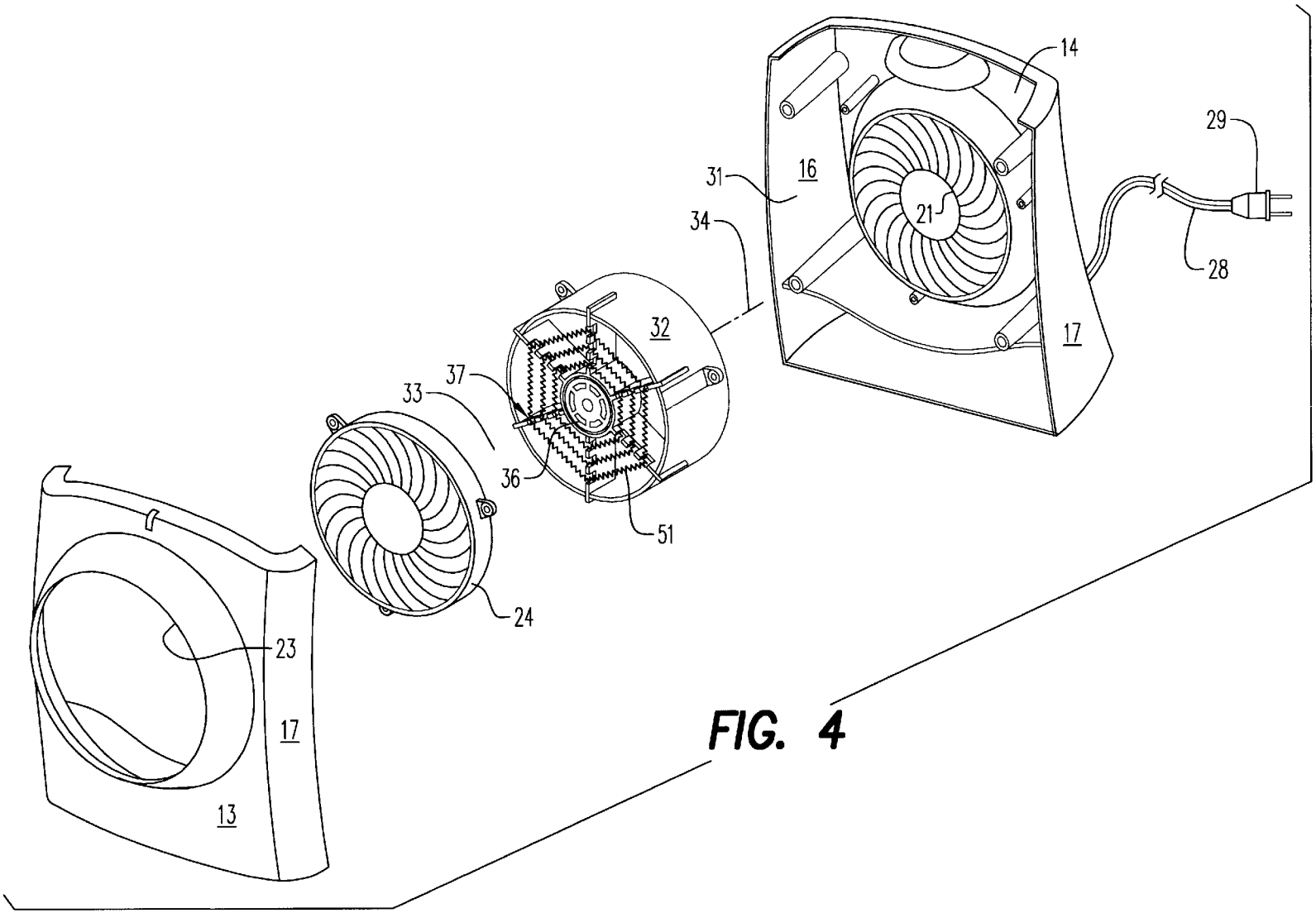
FIG. 4 is an exploded view showing certain components of the heater shown in FIGS. 1–3.

As illustrated in FIG. 4, the housing 12 defines an enclosure 31 and a cylindrical shroud 32 mounted in the enclosure 31 and partially defining an air flow path 33 extending between the air inlet 21 and the air outlet 23. The shroud 32 has an axis 34 substantially aligned with the air flow path 33 and retains a blower assembly 36 and a heating element assembly 37 aligned with the axis 34 of the shroud 32. During use of the heater 11, the selector board 25 is used to control operation of the blower assembly 36 and the heater element assembly 37 which produce heated air flow out of the air outlet 23.

Figure 5:
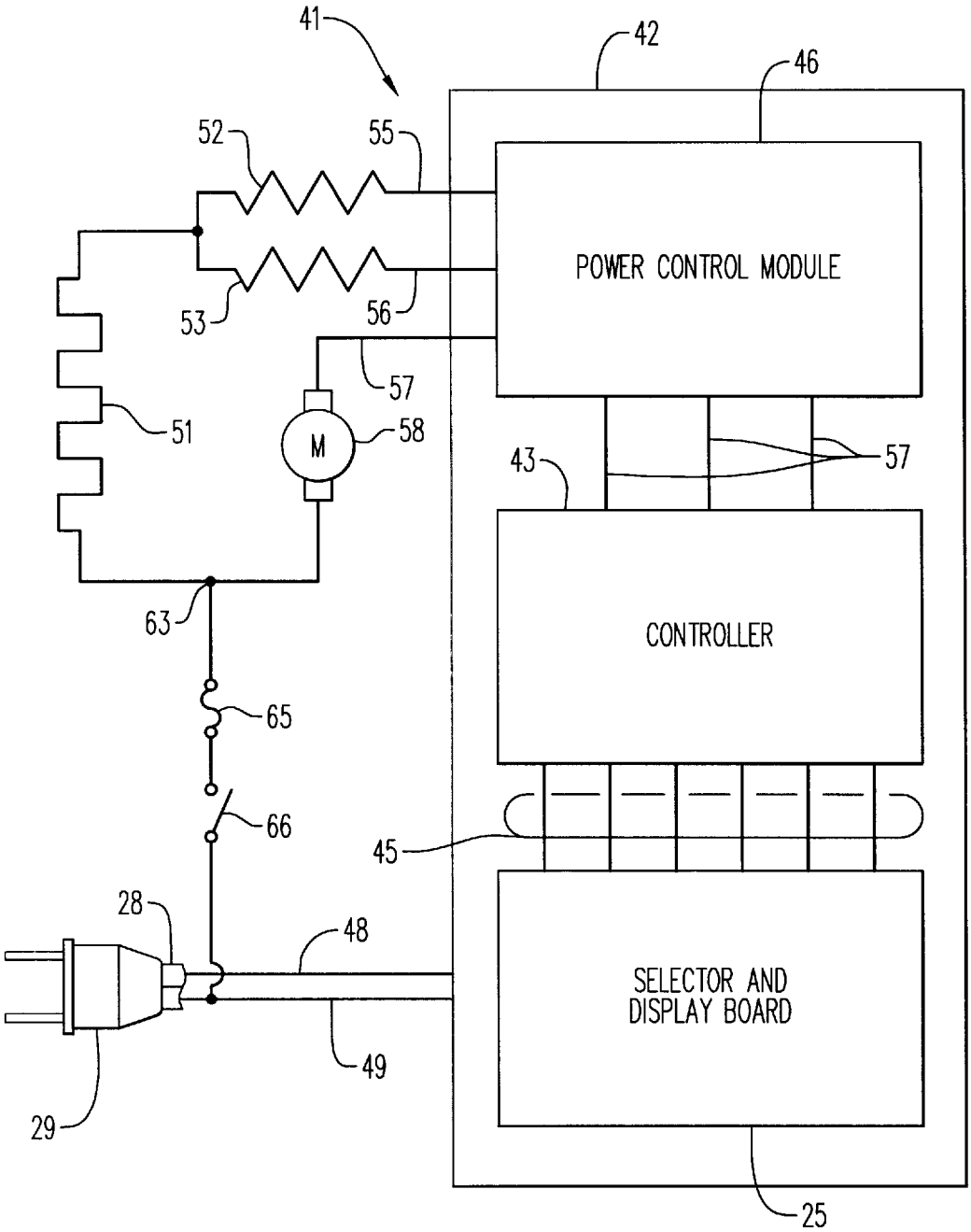
FIG. 5 is a schematic diagram of an electrical circuit for the heater shown in FIGS. 1–4.

Schematically illustrated in FIG. 5 is a control circuit 41 for the portable heater 11. A printed circuit board 42 includes an electronic controller 43 which interfaces with the selector and display board 25 via signal lines 45. Also included in the circuit board 42 is a power control module 46 which receives signals from the controller 43 on lines 47. Power is supplied to the circuit board 42 from the plug 29 and cord 28 on lines 48 and 49 and 51. A heater element 51 of the heater assembly 37 is connected in series with a parallel combination of current limiting resistors 52 and 53 which are connected, respectively, to output lines 55, 56 from the power control module 46. Another output line 57 from the power control module 46 is connected to a motor 61 of the blower assembly 36. Connected between a junction 63 receiving current from both the heater element 51 and the motor 58 and the neutral line 49 is the series combination of a fuse element 65 and a bimetallic switch 66 which opens in response to an excessive heat level within the housing 12.

As described hereinafter, the selector and display board 25 is manipulated selectively to provide inputs to the controller 43 which effects desired operation of the heater 11. In addition, the controller 43 feeds to the board 25 inputs which provide visual indications of the operation selected. Preferably, the controller 93 is a conventional microcontroller. However, other conventional devices such as micro-processors, integrated circuits, or programmable electronic arrays can be employed to provide the desired control of the heater 11.

Figure 6:
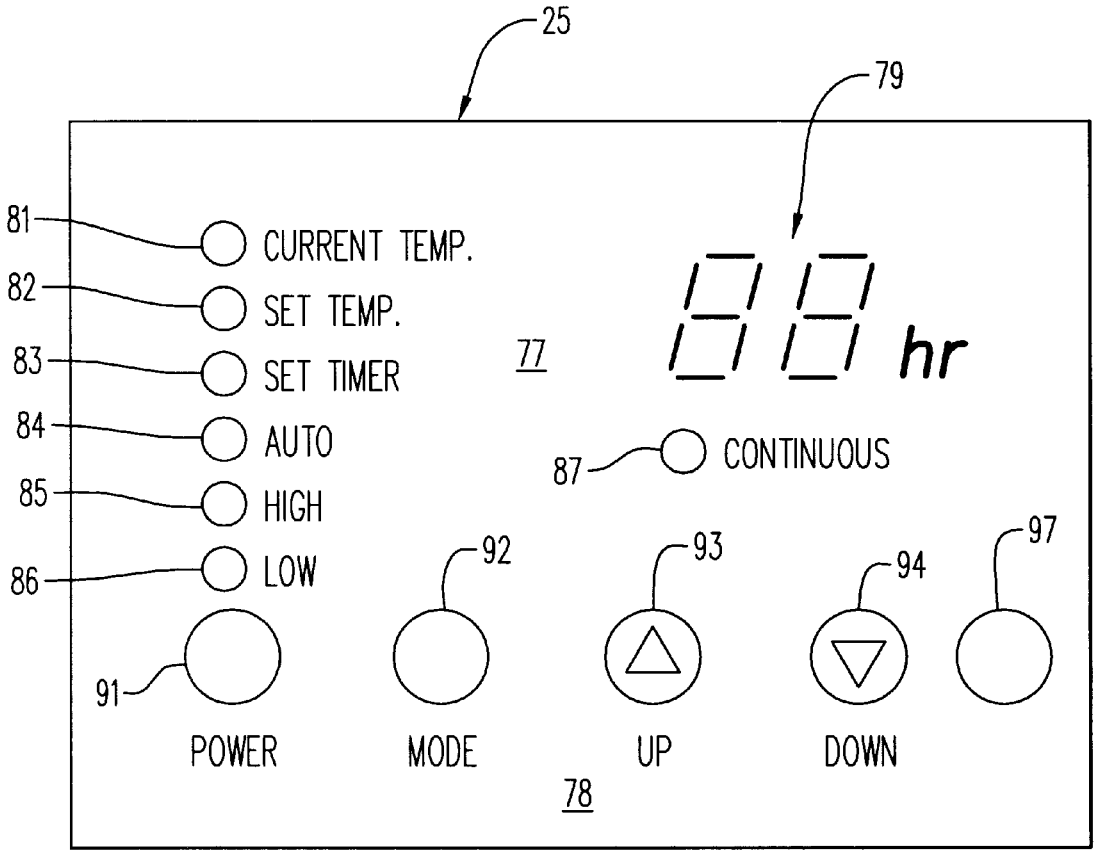
FIG. 6 is a diagrammatic view of a control and display board of the heater shown in FIGS. 1–5.

The board 25 has a display portion 77 and a operational mode selector portion 78 as shown in FIG. 6. Included in the display portion 77 is a digital display 79, an ambient temperature LED 81, a set temperature LED 82, a timer LED 83, an automatic operation LED 84, a high power LED 85, a lower power LED 86 and a continuous operation LED 87. The mode selector portion 78 includes a push button power switch 91, a push button mode switch 92, and first and second push button switches 93, 94 for selecting either desired temperature or time delays as described hereinafter. Also included on the board 25 is an ambient temperature sensor 97 which preferably is a thermistor but can include other types of conventional temperature sensing devices.

OPERATION

To initiate operation of the heater 11, the power switch 91 is pushed to energize the control circuit 41. Next, the mode switch 92 can be sequentially actuated providing the controller 43 with input signals which establish for the heater 11 a plurality of distinct operational modes. For example, one activation of the mode switch 92 produces an automatic ambient temperature mode while a second activation of the mode switch 112 provides a temperature selection mode. In the automatic ambient temperature mode, the controller 43 illuminates the current ambient temperature LED 81, produces on the digital display 79 the ambient temperature sensed by the sensor 97 and controls, with signals on lines 55 and 56, energization of the heater element 51 to maintain a preselected desired ambient temperature. The desired ambient temperature is maintained in the conventional manner by cycling energization and deenergization of the heater element 51 in response to inputs from the sensor 79. Conversely, in the temperature selection mode, the controller 43 illuminates the set temperature LED 82 and provides on the digital display 79 an indication of a selected desired ambient temperature. The displayed desired ambient temperature is increased by, for example, degree increments, by sequential activations of the first switch 93 or decreased by degree increments by sequential activation of the second switch 94. A predetermined delay period after the desired ambient temperature selection procedure, the controller 43 responds by returning to the automatic ambient temperature mode and providing an indication thereof by deenergizing the set temperature LED 82 and energizing the current ambient temperature LED 81.

Subsequent sequential activations of the mode switch 92 will provide to the controller 43 input signals establishing, respectively, a delayed shut-off mode or a continuous operation mode. In the continuous operation mode, the controller 43 illuminates the continuous operation LED 87 and maintains continuous energization of the heater element 51. In the delayed shut-off mode, the controller 43 illuminates the timer LED 83 and displays a selected delay period in the digital display 79. The selected and displayed delay period is increased in, for example, increments of one hour by sequential activations of the first switch 93 and is decreased incrementally by sequential activations of the second switch 94. A predetermined time after selection of a desired delay period the controller 43 automatically returns to the previously selected operational mode, either the automatic ambient temperature mode or the continuous operation mode. That occurrence is indicated by deenergization of the timer LED 83 and energization of either the current ambient temperature LED 82, or the continuous operation LED 87.

Subsequent sequential activations of the mode switch 92, establish, respectively, high operational power and low operational power modes. In the high power mode, the controller 43 illuminates the high power LED 85 and feeds current to the heater element 51 on line 55 to provide a given high IR power output of, for example, 1500 watts. Conversely, in the low operating power mode, the controller 43 illuminates the lower power LED 86 and feeds current to the heater element 51 on line 56 to produce a predetermined power output substantially less than the given power output produced in the high power operating mode. The selected power output mode will be maintained by the controller 43 during operation of the heater 11 in either the automatic ambient temperature mode or the continuous operation mode.

Obviously, many modifications and variations of the present invention are possible in light of the above teachings. It is to be understood, therefore, that the invention can be practiced otherwise than as specifically described.

What is claimed is:

1. A portable electrical heater comprising:

portable housing means defining an air inlet, an air outlet, and an air flow path between said air inlet and said air outlet;

blower means for circulating air through said air flow path;

an electrically powered heater element disposed in said air flow path;

a control board comprising selector means and comprising a mode switch means, and a temperature selector switch means, for effecting operation of said heater;

and display means comprising a digital display, an ambient temperature lamp and a set temperature lamp;

an ambient temperature sensor; and electronic controller means for controlling energization of said display means and said heater element in response to inputs from said selector means and said temperature sensor; and wherein said controller responds to an input from said temperature sensor and selective actuation of said mode switch means by establishing alternately a temperature selection mode or an automatic ambient temperature mode; and wherein in said temperature selection mode said controller means illuminates said set temperature lamp, and in response to activation of said temperature selector switch means provides on said digital display a selected temperature; and in said automatic ambient temperature mode said controller illuminates said ambient temperature lamp, provides on said digital display ambient temperature sensed by said temperature sensor, and controls energization of said heater element to maintain an ambient temperature equal to said selected temperature.

2. A heater according to claim 1 wherein said controller means automatically reestablishes said automatic ambient temperature mode a given time delay period after actuation of said mode switch means to establish said temperature selection mode.

3. A heater according to claim 2 wherein said temperature selector switch means comprises a first switch activatable to increase said selected temperature and a second switch, activatable to decrease said selected temperature.

4. A heater according to claim 2 wherein said display means further comprises an automatic operation lamp, and said controller means illuminates said automatic operation lamp in said automatic ambient temperature mode.

5. A heater according to claim 4 wherein said temperature selector switch means comprises a first switch activatable to increase said selected temperature and a second switch activatable to decrease said selected temperature.

6. A heater according to claim 1 wherein said display means further comprises a timer lamp and said selector means further comprises a delay period switch means; and said controller means further responds to selective actuation of said mode switch means to establish, alternatively to said temperature selection mode and said automatic ambient temperature mode, a delayed shut-off mode in which said controller means illuminates said timer lamp, and in response to activation of said delay period switch means provides on said digital display a selected delay period; and wherein after said selected delay period said controller means deenergizes said heater element.

7. A heater according to claim 6 wherein said controller means automatically reestablishes said automatic ambient temperature mode a given time delay period after activation of said delay period switch means.

8. A heater according to claim 7 wherein said delay period switch means comprises a first switch activatable to increase said selected delay period and a second switch activatable to decrease said selected delay period.

9. A heater according to claim 8 wherein said controller means automatically reestablishes said automatic ambient temperature mode a given time delay period after actuation of said mode switch means to establish said temperature selection mode.

10. A heater according to claim 9 wherein in said temperature selection mode said first switch is activatable to increase said selected temperature, and said second switch is activatable to decrease said selected temperature.

11. A heater according to claim 9 wherein said display means further comprises an automatic operation lamp, and said controller means illuminates said automatic operation lamp in said automatic ambient temperature mode.

12. A heater according to claim 11 wherein said temperature selector switch means comprises a first switch activatable to increase said selected temperature and a second switch activatable to decrease said selected temperature.

13. A heater according to claim 1 wherein said display means further comprises a continuous operation lamp; and said controller further responds to selective actuation of said mode switch means by illuminating said continuous operation lamp and establishing alternatively to said automatic ambient temperature mode a continuous operation mode in which said heater element is continuously energized.

14. A heater according to claim 13 wherein said display means further comprises a timer lamp and said selector means further comprises a delay period switch means; and said controller means further responds to selective actuation of said mode switch means to establish alternatively to said temperature selection mode and said automatic ambient temperature mode, a delayed shut-off mode in which said controller means illuminates said timer lamp, and in response to activation of said delay period switch means provides on said digital display a selected delay period; and wherein after said selected delay period said controller means deenergizes said heater element.

15. A heater according to claim 14 wherein said controller means automatically reestablishes said automatic ambient temperature mode a given time delay period after activation of said delay period switch means.

16. A heater according to claim 15 wherein said delay period switch means comprises a first switch activatable to increase said selected delay period and a second switch activatable to decrease said selected delay period.

17. A heater according to claim 1 wherein said display means; further comprises a high power lamp and a low power lamp; and said controller means further responds to selective actuation of said mode switch means by establishing alternatively either a high power mode or a low power mode; and wherein in said high power mode said controller illuminates said high power lamp and energizes said heater at a given power level, and in said low power mode illuminates said low power lamp and energizes said heater at a predetermined power level substantially less than said given power level.

18. A heater according to claim 17 wherein said display means further comprises a timer lamp and said selector means further comprises a delay period switch means; and said controller means further responds to selective actuation of said mode switch means to establish alternatively to said temperature selection mode and said automatic ambient temperature mode, a delayed shut-off mode in which said controller means illuminates said timer lamp, and in response to activation of said delay period switch means provides on said digital display a selected delay period; and wherein after said selected delay period said controller means deenergizes said heater element.

19. A heater according to claim 18 wherein said mode switch means is a single switch, and said controller means responds to sequential activations of said single switch to provide sequentially said modes.

* * * * *